US005316536A

United States Patent [19]

Aiura et al.

[11] Patent Number: 5,316,536

[45] Date of Patent: May 31, 1994

[54] PHOTORECEPTOR DRUM SUBSTRATE AND A METHOD OF MANUFACTURING THE SAME

[75] Inventors: Tadashi Aiura; Takahiro Nose; Shunichi Umemoto; Kenji Hayashi, all of Shimonoseki, Japan

[73] Assignee: Kabushiki Kaisha Kobe Seiko SHO, Kobe, Japan

[21] Appl. No.: 858,866

[22] Filed: Mar. 27, 1992

[30] Foreign Application Priority Data

Mar. 28, 1991 [JP] Japan ..... 3-091292

[51] Int. Cl.[5] ..... G03G 05/10

[52] U.S. Cl. ..... 492/58

[58] Field of Search ..... 29/130, 132; 355/211; 492/54, 58

[56] References Cited

U.S. PATENT DOCUMENTS 3,937,571 2/1976 Kizulik et al. ..... 355/211
4,207,059 6/1980 Gaitten et al. ..... 29/132
4,631,809 12/1986 Yokoi ..... 29/607
4,914,478 4/1990 Yashiki ..... 355/211

FOREIGN PATENT DOCUMENTS 1-170949 7/1989 Japan .

*Primary Examiner*—Mark Rosenbaum
*Assistant Examiner*—Kenneth J. Hansen
*Attorney, Agent, or Firm*—Oblon, Spivak, McClelland, Maier & Neustadt

[57] ABSTRACT

A photoreceptor drum substrate comprising a drum of aluminum or aluminum alloy polished at the surface by centerless polishing. The photoreceptor drum substrate is manufactured by applying extrusion to a blank made of aluminum or aluminum alloy, then applying drawing to obtain a pipe material with less than 0.1% of bending to the entire length and satisfying the relation for wall thickness t, outer diameter $\phi$ and yield strength $\sigma_{0.2}$, $t^2 \times \sigma_{0.2}/\phi \geqq 0.2$ and then applying centerless polishing to the surface of the drum.

3 Claims, 2 Drawing Sheets

PHOTORECEPTOR DRUM SUBSTRATE AND A METHOD OF MANUFACTURING THE SAME

BACKGROUND OF THE INVENTION

1. Field of the Invention

The present invention concerns a photoreceptor drum substrate used, for example, in copying machines and printers, as well a method of manufacturing the photoreceptor drum substrate.

2. Description of the Prior Art

For the photoreceptor drum substrate of this kind, an aluminum pipe has been used so far, for which high dimensional accuracy is required. For instance, in a photoreceptor drum substrate of 30 mm diameter, it is required to define the roundness thereof to less than 30 μm and define the straightness to less than 30 μm.

In a case of obtaining such a dimensional accuracy, the surface of the aluminum pipe (extruded and drawn pipe) is cut at a high accuracy by using a lathe and a diamond tool. Further, a method of decreasing the roundness and the straightness each to less than 30 μm by applying extrusion and drawing on an aluminum pipe has been developed and practiced.

However, the known method of manufacturing the photoreceptor drum substrate described above involves the following problems.

First, in a precision cutting method for cutting an aluminum pipe by using a diamond tool or the like. The production cost for the photoreceptor drum substrate is increased remarkably and the productivity was poor.

On the other hand, in the precision drawing method of applying precision extrusion and drawing to an aluminum pipe at a high accuracy, although post-treatment such as cutting is unnecessary and the production cost is low, the aluminum pipe has to be cut short and the roundness of the aluminum pipe is worsened upon cutting to reduce the yield of products. Further, flaws caused by handling are liable to be formed at the surface of the aluminum pipe upon drawing.

OBJECT AND SUMMARY OF THE INVENTION

The present invention has been accomplished in view of the foregoing problems and it is an object thereof to provide a photoreceptor drum substrate of high dimensional accuracy, as well as a method of manufacturing a photoreceptor drum substrate capable of manufacturing such a photoreceptor drum substrate at a reduced cost.

The photoreceptor drum according to the present invention comprises a pipe material of aluminum or aluminum alloy polished at the surface by centerless polishing.

A method of manufacturing the photoreceptor drum substrate according to the present invention comprises applying extrusion to a blank made of aluminum or aluminum alloy, then applying drawing to obtain a pipe material with less than 0.1% of bending to the entire length and capable of satisfying a condition of wall thickness t, outer diameter $\phi$ and yield strength $\sigma_{0.2}$ of $t^2 \times \sigma_{0.2}/\phi \geqq 0.2$ and then applying centerless polishing to the surface of the pipe material.

The present inventors have made various experiments and studies for developing a method of manufacturing a photoreceptor drum substrate capable of manufacturing a photoreceptor drum substrate at a high dimensional accuracy such as roundness at a reduced cost and, as a result, have found that a pipe material of aluminum or aluminum alloy polished at the surface by centerless polishing applied so far to the removal of flaws from the surface of pipe material or a rod material has a high dimensional accuracy, satisfactory surface state and require a reduced manufacturing cost and, accordingly, it is suitable to the photoreceptor drum substrate.

Further, in the centerless polishing, since the pipe material of aluminum or aluminum alloy can be cut short and, subsequently, polished at the surface, the cylindricity of the photoreceptor drum substrate can be improved as compared with that by the existent precision extension method. For instance, even a pipe material of an ordinary accuracy with the diameter of 30 μmm and each of the roundness and the cylindricity being 50 μm respectively, the roundness and the cylindricity can be improved each to 20 μm.

However, when the surface of the pipe material of aluminum or aluminum alloy is subjected to centerless polishing, distortion of oxide layers is caused to a portion thereof deposited with cutting or dust, a portion scorched upon centerless polishing or a portion injured by a blade, which may lead to leak of charges at the surface of the photoreceptor drum substrate. Then, if charge leaks should be caused to the photoreceptor drum substrate, image defects are caused to the photoreceptor body. In view of the above, it is preferred to form an anodization layer to the surface of the pipe material by applying anodization. In this case, if the thickness of the anodization layer exceeds 8 μm, cracks may be formed to the anodized layer. Accordingly, it is preferred to limit the thickness of the anodization layer formed on the surface of the pipe material to less than 8 μm.

Description will now be made of the method of manufacturing the photoreceptor drum substrate according to the present invention. At first, a blank made of aluminum or aluminum alloy is extruded and then subjected to drawing to obtain a pipe material made of aluminum or aluminum alloy. Subsequently, centerless polishing is applied to the pipe material. In this case, if bending to the entire length of the pipe material exceeds 0.1%, spiral patterns are formed at the surface of the pipe material due to friction with a blade during the centerless polishing. In particular, the spiral patterns are developed remarkably in a case of disposing the anodized layers at the surface of the pipe material. In this way, if the spiral patterns are formed on the surface of the pipe material, the reflectance of the photoreceptor drum substrate changes locally due to the spiral pattern to bring about image failure in the photoreceptor body. In view of the above, the pipe material of aluminum or aluminum alloy subjected to centerless polishing is drawn so that bending to the entire length is less than 0.1%. This can improve the image quality of the photoreceptor material.

Further, in order to improve the dimensional accuracy of the photoreceptor drum substrate, it is necessary to prevent the deformation of the pipe material subjected to the centerless polishing. In view of the above, the wall thickness t and the yield strength $\sigma_{0.2}$ are increased in proportion with the outer diameter $\phi$. As the result of the experiment and the study, it has been found that the deformation of the pipe material can be prevented if the following relation is satisfied for the wall thickness t, the outer diameter $\phi$ and the yield strength $\sigma_{0.2}$. That is, if the calculated value for $t^2 \times \sigma_{0.2}/\phi$ is less than 0.2, since the pipe material deforms upon centerless polishing, the dimensional accuracy of the photoreceptor drum substrate can not be improved. Accordingly, the pipe material put to the centerless polishing is drawn so as to satisfy the relation: $t^2 \times \sigma_{0.2}/\phi \geqq 0.2$. For instance, in a case of the pipe material of aluminum or aluminum alloy having a material strength (yield strength $\sigma_{0.2}$) of 8 kg/mm$^2$ and the outer diameter $\phi$ of 30 $\mu$mm, the wall thickness t is made greater than 0.86 mm.

The yield strength $\sigma_{0.2}$ of the pipe material can be increased by adding Mg, Mn or Cu, etc. to the blank made of aluminum or aluminum alloy. Further, the yield strength $\sigma_{0.2}$ of the pipe material out to the centerless polishing can be adjusted by applying work hardening to the pipe material by disposing a cold drawing step.

Furthermore, flaws with a depth of greater than 10 $\mu$m may sometimes be formed to the surface of the pipe material obtained by the drawing. Then, it is necessary to apply centerless polishing at a depth of greater than 10 $\mu$m to the surface of the pipe material. If polishing is made in excess of 100 m depth at a time or several times, since the load on the grinding stone is increased, deformation may possibly be caused to the pipe material. Further, while the centerless polishing has a function of amending the shape of the pipe material, such a shape amending effect can not be obtained if the depth is less than 10 $\mu$m, whereas clogging is caused to the grinding stone if the thickness exceeds 100 $\mu$m at a time. Accordingly, the grinding depth to the pipe material obtained by the drawing is desirably from 10 to 100 $\mu$m at a time.

In the present invention, the pipe material can be passed continuously through a plurality of centerless grinding machines. In such a case, it is preferred to define the total depth of grinding from 10 $\mu$m.

Further, the anodization layer can be formed by applying anodization to the surface of the pipe material after centerless polishing.

As described above, according to the present invention, a photoreceptor drum substrate at a high dimensional accuracy can be manufactured at a reduced cost.

DESCRIPTION OF THE ACCOMPANYING DRAWINGS

These and other objects as well as advantageous features of the present invention will become apparent by reading the descriptions for the preferred embodiments according to the present invention with reference to the accompanying drawings, wherein.

DESCRIPTION OF THE PREFERRED EMBODIMENTS

The present invention will now be explained by way of its preferred embodiments with reference to the accompanying drawings.

Figure 1:
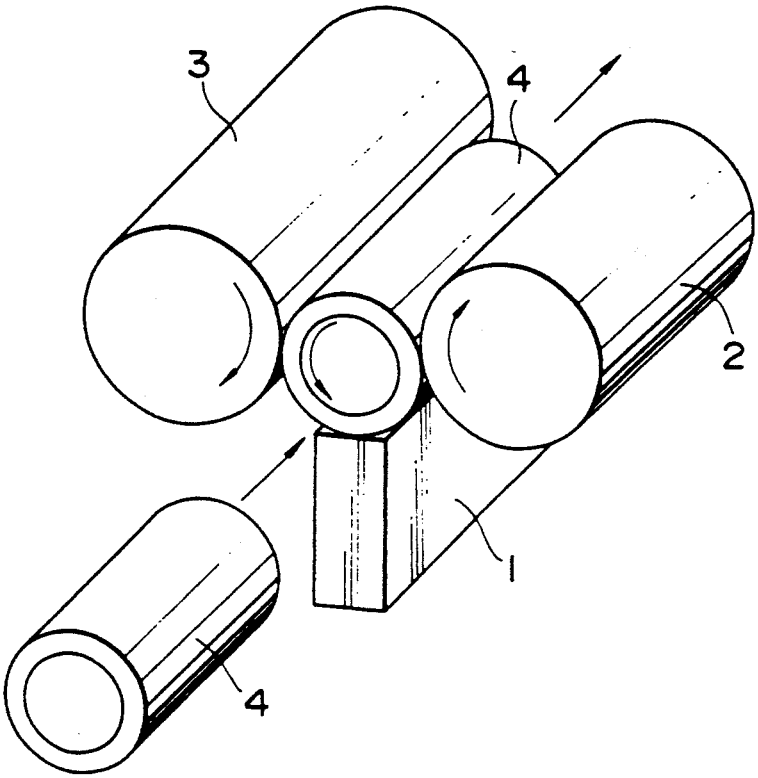
FIG. 1 is a perspective view illustrating a through field centerless polishing machine.

FIG. 1 is a perspective view illustrating a through-field centerless polishing machine. An aluminum pipe 4 is disposed on a blade 1. A feed roll 2 and a polishing roll 3 are disposed along the longitudinal direction of the aluminum pipe 4 and adapted to rotate in the directions opposite to each other with the center axis thereof as the axis of rotation, on both sides of the aluminum pipe. The aluminum pipe 4 tends to rotate at the same rotational speed of the polishing roll 3 under high speed rotation. However, since it is braked by a frictional force undergoing from the feed roll 2 at a low rotational speed and the blade 1, the aluminum pipe 4 rotates substantially at the same velocity as that of the feed roll 2. Accordingly, the surface of the aluminum pipe 4 is polished by the polishing roll 3. Further, since the center axis of feed roll 2 is slightly inclined, the aluminum pipe 4 is conveyed to the longitudinal direction thereof. In this way, the aluminum pipe 4 is successively put to polishing fabrication.

Figure 2:
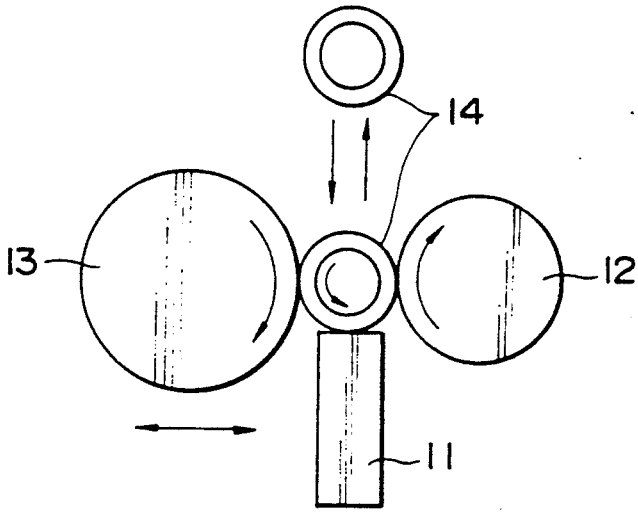
FIG. 2 is a side elevational view illustrating an infield centerless polishing machine.

FIG. 2 is a side elevational view illustrating an infield centerless polishing machine. An aluminum pipe 14 is disposed on a blade 11. Polishing rolls 12 and 13 are disposed along the longitudinal direction of the aluminum pipe 14 and adapted to rotate in the directions opposite to each other with the center axis thereof as the axis of rotation on both sides of the aluminum pipe 14. In this case, the surface of the aluminum pipe 14 is polished by the polishing rolls 12 and 13. The polishing roll 13 can be moved in the direction apart from the aluminum pipe 14 and the aluminum pipe 4, after polishing, is conveyed above the blade 11.

Figure 3:
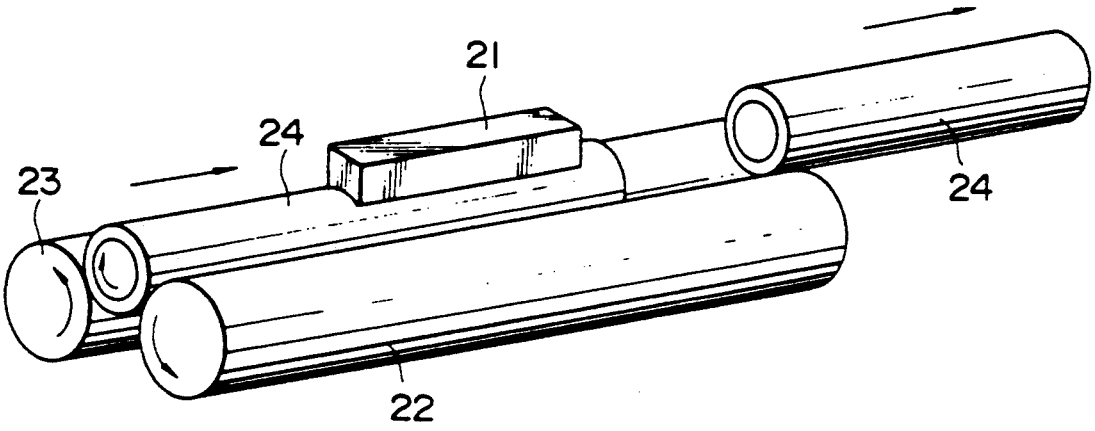
FIG. 3 is a perspective view illustrating a through field centerless finish-polishing machine.

FIG. 3 is a perspective view illustrating a through-field centerless finish-polishing machine. Feed rollers 22 and 23 ar disposed substantially in parallel with each other and adapted to rotate in the directions opposite to each other with the center axis thereof as the axis of rotation. An aluminum pipe 24 is mounted on the feed rolls 22, 23, and rotates in accordance with the rotational speed of the feed rolls 22 and 23. Then, the surface of the aluminum pipe 24 is finish-polished by a grinding stone 21. The aluminum pipe 24 after the polishing, is transported in the longitudinal direction thereof.

By using the polishing machines shown in FIG. 1 through FIG. 3 in an appropriate combination, the aluminum pipe can be polished to a predetermined surface roughness.

Description will now be made to a case of actually manufacturing a photoreceptor drum substrate according to the embodiment of the present invention by using the above-mentioned polishing machine, in comparison with a conventional example or a reference example.

At first, an aluminum pipe 30.5 mm in outer diameter, 28 mm in inner diameter and 260 mm in length (JIS 3000 material) was obtained by an ordinary method. Then, centerless polishing was applied at a 20 $\mu$m polishing depth to the surface of the aluminum pipe. In this way, a photoreceptor drum substrate according to Examples 1 and 2 was manufactured.

On the other hand, a photoreceptor drum substrate comprising an aluminum pipe 30.5 mm in outer diameter, 18 mm in inner diameter and 260 mm in length was manufactured by a precision drawing as a conventional Example 1. Further, a photoreceptor drum substrate was manufactured, as a Conventional Example 2, by subjecting an aluminum pipe 30.5 mm in outer diameter, 23 mm in inner diameter and 260 mm in length to precision cutting by a diamond tool. Further, as a conventional Example 3, a photoreceptor drum substrate was manufactured by applying centerless polishing to a long aluminum pipe 30.5 mm in outer diameter, 28 mm in inner diameter and 2 m in length and then the aluminum pipe was cut into a short length of 260 mm.

For the photoreceptor drum substrates according to the Examples 1, 2 and Conventional Examples 1 to 3 obtained in this way, the dimensional accuracy was measured before and after the polishing and the dimensional accuracy was evaluated. Further, a ratio of surface fabrication time to the surface fabrication time by diamond cutting was determined to evaluate the productivity. The results are shown in the following Table 1.

TABLE 1

(No. 1)

| | Dimensional accuracy before polishing (μm) | | | Dimensional accuracy after polishing (μm) | | |
|---|---|---|---|---|---|---|
| | Roundness | Straightness | Cylindricity | Roundness | Straightness | Cylindricity |
| Example | | | | | | |
| 1 | 30 | 30 | 40 | 15 | 20 | 15 |
| 2 | 50 | 50 | 50 | 20 | 20 | 20 |
| Conventional Example | | | | | | |
| 1 | 25 | 35 | 30 | no polishing | | |
| 2 | 50 | 50 | 30 | 15 | 15 | 15 |
| 3 | 50 | 50 | 40 | 25 | 25 | 40 |

TABLE 1

(No. 2)

| | Evaluation for dimensional accuracy | Ratio of surface fabrication time | Evaluation for productivity | Overall Evaluation |
|---|---|---|---|---|
| Example | | | | |
| 1 | ○ | 0.5 | ○ | ○ |
| 2 | ○ | 0.5 | ○ | ○ |
| Conventional Example | | | | |
| 1 | x | — | — | x |
| 2 | ○ | 1 | x | x |
| 3 | ○ | 0.4 | ○ | x |

As apparent from Table 1, any of the photoreceptor drum substrates in Examples 1 and 2 had high dimensional accuracy and productivity, which were satisfactory as the photoreceptor drum substrates to be used, for example, in copying machines.

On the other hand, the photoreceptor drum substrate of Conventional Example 1 obtained by precision drawing required no surface fabrication but was poor in dimensional accuracy. Further, the photoreceptor drum substrate of Conventional Example 2 obtained from the aluminum pipe through diamond cutting required a long time for the surface fabrication and was poor in productivity. Furthermore, the photoreceptor drum substrate of conventional Example 3 obtained by cutting the aluminum pipe short after centerless polishing was poor in the dimensional accuracy, in which the cylindricity was worsened upon cutting.

Then, an aluminum pipe 30.5 mm in outer diameter, 28 mm in inner diameter and 260 mm in length was obtained by an ordinary method.

Then, in Example 3, a photoreceptor drum substrate was manufactured by applying centerless polishing to an aluminum pipe with 0.08% of bending relative to the entire length, to provide 1 μm of surface roughness $R_{max}$ and, subsequently, forming an anodized layer of 4 μm thickness on the surface. Further, in Example 4, a photoreceptor drum substrate was manufactured by applying centerless polishing to an aluminum pipe with 0.05% of bending to the entire length to provide 0.5 μm of surface roughness $R_{max}$ and, subsequently, forming an anodized layer of 6 μm thickness on the surface.

On the other hand, in Comparative Example 1, a photoreceptor drum substrate was manufactured by applying centerless polishing to an aluminum pipe with 0.08% of bending to the entire length to provide 1 μm of surface roughness $R_{max}$. Further, in Comparative Example 2, a photoreceptor drum substrate was manufactured by applying centerless polishing to an aluminum pipe with 0.15% of bending to the entire length to provide 1 μm of surface roughness $R_{max}$ and then forming an anodized layer of 6 μm thickness on the surface. Furthermore, in Comparative Example 3, a photoreceptor drum substrate was manufactured by applying centerless polishing to an aluminum pipe with 0.15% of bending to the entire length to provide 0.5 μm of surface roughness $R_{max}$ and, subsequently, forming an anodized layer of 10 μm thickness on the surface.

The photoreceptor drum substrates in Examples 3 and 4 and Comparative Examples 1 to 3 thus obtained were evaluated with naked eyes for the state of the surface. The results are shown in Table 2.

In Table 2, "o" shows those having satisfactory surface of the aluminum pipe after anodization and "x" shows those having defects such as deposition of cutting dust or occurrence of cracks at the surface. Further, "o" shows those having no blade patterns at the surface of the photoreceptor drum and, "x" shows those having blade patterns formed on the surface.

TABLE 2

| | Surface defect | Blade pattern | Overall Evaluation |
|---|---|---|---|
| Example | | | |
| 3 | ○ | ○ | ○ |
| 4 | ○ | ○ | ○ |
| Comparative Example | | | |
| 1 | x | ○ | x |
| 2 | ○ | x | x |
| 3 | x | x | x |

As apparent from Table 2, any of the photoreceptor drum substrates in Examples 3 and 4 showed neither surface defects nor blade patterns and had excellent properties as the photoreceptor drum substrate used, for example, in copying machines.

On the other hand, in the photoreceptor drum substrate of Comparative Example 1 with no anodization layer, defects were caused to the surface of the aluminum pipe. Further, in the photoreceptor drum substrate of Comparative Example 2 with 0.15% of bending in the aluminum pipe put to centerless polishing, blade patterns were formed on the surface of the photoreceptor drum substrate after anodization. Furthermore, in the photoreceptor drum substrate of Comparative Example 3 with 0.15% of bending and with anodization film of 10 μm thickness of the aluminum pipe put to the centerless polishing, blade patterns were formed at the surface of the photoreceptor drum substrate after the anodization and cracks were caused to the anodization layer.

Next, aluminum pipes with the material, wall thickness $t^2$ ($mm^2$), outer diameter $\phi$ (mm) and yield strength $\sigma_{0.2}$ ($kg/mm^2$) shown in the following Table 3 were obtained by an ordinary method. Then, photoreceptor drum substrates of Examples 5 to 8 and Comparative Examples 4 to 7 were manufactured by applying centerless polishing at 30 μm thickness to the surface of the aluminum pipes. The feeding rate of the aluminum pipe was set to 2 m/min.

Calculated values: $t^2 \times \sigma_{0.2}/\phi$ (kg/mm) were determined for the photoreceptor drum substrates of Examples 5 to 8 and Comparative Examples 4 to 7 obtained in this way and the dimensional accuracy (roundness, distortion and cylindricity) thereof was measured. The results also shown together in Table 3.

In Table 3, "o" indicates those with such a dimensional accuracy that all of roundness, distortion and cylindricity are less than 40 μm, "Δ" shows those with one of the roundness, distortion and cylindricity being in excess of 40 μm, while "x" shows those in which all of roundness, distortion and cylindricity exceed 40 μm.

As is apparent from Table 3, each of the photoreceptor, drum substrates of Examples 5 to 8, according to the invention had high dimensional accuracy.

On the other hand, each of the photoreceptor drum substrates in Comparative Examples 4 to 7 with $t^2 \times \sigma_{0.2}/\phi$ being less than 0.2 was poor in the dimensional accuracy.

TABLE 3

| | Kind | Wall thickness | Outer diameter | Yield strength | Measured value | Dimensional accuracy | Overall Evaluation |
|---|---|---|---|---|---|---|---|
| | JIS | $t^2$ | $\phi$ | $\sigma_{0.2}$ | | | |
| Example | | | | | | | |
| 5 | 3003 material | 0.64 | 30 | 10 | 0.21 | ◎ | ◎ |
| 6 | 3003 material | 1 | 40 | 10 | 0.26 | ◎ | ◎ |
| 7 | 1050 material | 1 | 30 | 6 | 0.2 | ◎ | ◎ |
| 8 | 1050 material | 1.5 | 40 | 6 | 0.23 | ◎ | ◎ |
| Comparative Example | | | | | | | |
| 4 | 3003 material | 0.55 | 30 | 10 | 0.18 | Δ | x |
| 5 | 3003 material | 0.6 | 40 | 10 | 0.15 | x | x |
| 6 | 1050 material | 0.8 | 30 | 6 | 0.16 | Δ | x |
| 7 | 1050 material | 1 | 40 | 6 | 0.15 | x | x |

As has been described above, since the photoreceptor drum substrate according to the present invention is polished by the centerless polishing at the surface of a pipe material made of aluminum or aluminum alloy, the dimensional accuracy is high and the surface stat is satisfactory.

Further, by the method of manufacturing the photoreceptor drum substrate according to the present invention, since a pipe material of aluminum or aluminum alloy with bending to the entire length being defined to a predetermined value and having a predetermined relationship between each of the wall thickness t, the outer diameter $\phi$ and the yield strength $\sigma_{0.2}$ is formed and, subsequently, centerless polishing is applied to the surface of the pipe material, an excellent photoreceptor drum substrate can be manufactured at a reduced cost as described above.

What is claimed is:

1. A photoreceptor drum substrate comprising a cylindrically formed drum of aluminum or aluminum alloy polished at its outer surface by centerless polishing, prepared by extruding a blank made of aluminum or aluminum alloy, then drawing said blank to obtain a drum with less than 0.1% of bending of the entire length and satisfying a relation for wall thickness t, outer diameter $\phi$ and yield strength $\sigma_{0.2}$ of $t^2 \times \sigma_{0.2/\phi} \geqq 0.2$ and then applying centerless polishing to the outer surface of the resulting drum.

2. A photoreceptor drum substrate as defined in claim 1, wherein centerless polishing is applied at a depth of 10 to 100 micrometers.

3. A photoreceptor drum substrate as defined in claim 1 or 2, wherein anodization is applied to the outer surface of the drum after centerless polishing to form an anodized layer with a thickness of less than 8 micrometers.

* * * * *